US008791282B2

(12) United States Patent
McKee

(10) Patent No.: US 8,791,282 B2
(45) Date of Patent: Jul. 29, 2014

(54) IONIC LIQUIDS FOR AGRICULTURAL RESIDUE REMOVAL

(75) Inventor: Mary Amanda McKee, Cincinnati, OH (US)

(73) Assignee: Givudan S.A., Vernier (CH)

( * ) Notice: Subject to any disclaimer, the term of this patent is extended or adjusted under 35 U.S.C. 154(b) by 0 days.

(21) Appl. No.: 14/128,339

(22) PCT Filed: Jun. 27, 2012

(86) PCT No.: PCT/EP2012/062414

§ 371 (c)(1),
(2), (4) Date: Dec. 20, 2013

(87) PCT Pub. No.: WO2013/000935

PCT Pub. Date: Jan. 3, 2013

(65) Prior Publication Data

US 2014/0128626 A1 May 8, 2014

Related U.S. Application Data

(60) Provisional application No. 61/502,011, filed on Jun. 28, 2011.

(51) Int. Cl.
*C11B 9/00* (2006.01)

(52) U.S. Cl.
USPC ..... 554/184; 554/175; 554/187

(58) Field of Classification Search
USPC ..... 554/175, 184, 187
See application file for complete search history.

(56) References Cited

U.S. PATENT DOCUMENTS

| | | | | |
|---|---|---|---|---|
| 4,956,429 | A | 9/1990 | Harmetz et al. | |
| 5,558,893 | A | 9/1996 | Muraldihara | |
| 2006/0286134 | A1* | 12/2006 | Olansky et al. | 424/401 |
| 2007/0237844 | A1* | 10/2007 | Carlson et al. | 424/736 |
| 2010/0163018 | A1* | 7/2010 | Gifford et al. | 127/37 |
| 2011/0212037 | A1 | 9/2011 | Takeuchi et al. | |

FOREIGN PATENT DOCUMENTS

| | | | |
|---|---|---|---|
| CN | 101191103 | A | 6/2008 |
| CN | 101195789 | A | 6/2008 |
| CN | 101205504 | A | 6/2008 |
| WO | WO 2004/082800 | A1 | 9/2004 |
| WO | WO 2007/001697 | A1 | 1/2007 |
| WO | WO 2011/070103 | A1 | 6/2011 |
| WO | WO 2011070103 | A1 * | 6/2011 |

OTHER PUBLICATIONS

PCT/EP2012/062414—International Search Report, Aug. 3, 2012.
PCT/EP2012/062414—International Written Opinion, Aug. 3, 2012.
PCT/EP2012/062414—International Preliminary Report on Patentability, Jan. 7, 2014.
GB 1113737.9—Great Britain Search Report, Dec. 2, 2011.
Katharina Bica, et al., "Ionic Liquids and Fragrances—Direct Isolation of Orange Essential Oil", Green Chem., 2011, vol. 13, pp. 1997-1999, The Royal Society of Chemistry, Great Britain.
Y. Ito, et al., "Application of Ion-Exchange Cartridge Clean-Up In Food Analysis. I. Simultaneous Determination of Thiabendazole and Imazalil in Citrus Fruit and Banana Using High-Performance Liquid Chromatography with Ultraviolet Detection", Journal of Chromatography, Jun. 12, 1998, vol. 810, Nos. 1 and 2, pp. 81-87. (Abstract).
Y. Yamazaki, et al., "Determination of Benomyl, Diphenyl, O-Phenylphenol, Thiabendazole, Chlorpyrifos, Methidathion, and Methyl Parathion in Oranges by Solid-Phase Extraction, Liquid Chromatography, and Gas Chromatography", Journal of AOAC International,1999, vol. 82, No. 6, pp. 1474-1478. (Abstract).
Sandra M. Garland, et al., "Determination of Pesticide Minimum Residue Limits in Essential Oils—Report No. 4", Rural Industries Research and Development Corporation, Jun. 2004, Australia.
Alberto Arce, et al., "Essential Oil Terpenless by Extraction Using Organic Solvents or Ionic Liquids", AIChE Journal, Jun. 2006, vol. 52, No. 6, pp. 2089-2097, American Institute of Chemical Engineers.
Sara Lago, et al., "Deterpenation of Citrus Essential Oil by Liquid-Liquid Extraction with 1-Alkyl-3-methylimidazolium Bis(trifluoromethylsulfonyl)amide Ionic Liquids", Journal of Chemical & Engineering Data, Mar. 7, 2011, vol. 56, pp. 1273-1281, American Chemical Society.

* cited by examiner

*Primary Examiner* — Deborah D Carr
(74) *Attorney, Agent, or Firm* — Curatolo Sidoti Co., LPA; Joseph G. Curatolo; Salvatore A. Sidoti

(57) ABSTRACT

A method of reducing the proportion of agricultural residues (ARs), such as pesticides and herbicides, present in an essential oil, comprising the treatment of the oil with an ionic liquid that has at most limited solubility in the oil, the ionic liquid having an anion and a cation chosen from the following table:

| cation | anion |
|---|---|
| dialkylimidazolium | alkylsulfate |
| trialkylimidazolium | dicyanamide |
| dialkylpyridinium | alkylsulfonate |
| dialkylpyrrolidinium | alkylphosphate |
| | thiocyanate |
| | fluoroacetate |
| | fluoroalkyl sulfonate |
| | tetrafluoroborate |
| | halide |

The method is particularly effect with citrus oils, especially orange oil, and it can remove most ARs, without removing essential components of the oil.

7 Claims, No Drawings

IONIC LIQUIDS FOR AGRICULTURAL RESIDUE REMOVAL

CROSS REFERENCE TO RELATED APPLICATIONS

This application is a national stage application of International Application No. PCT/EP2012/062414, filed 27 Jun. 2012, which claims priority from U.S. Provisional Patent Application No. 61/502,011, filed 28 Jun. 2011, from which applications priority is claimed, and which are incorporated herein by reference.

This disclosure relates to a method of removing agricultural residues from essential oils.

Agricultural residues (hereinafter ARs) are the remnants of various agricultural chemicals that have been applied to cultivated plants and trees and which are found in the harvested crops or in products derived from them, sometime in trace amounts, but often in more substantial proportions. These materials are applied for the purpose of controlling pests (insects and arachnids) and fungal growths. They are highly toxic to the target organisms, which sometimes makes them toxic to human consumers. It is therefore desirable that as much as possible of these ARs be removed from plant-derived essential oils. There are literally hundreds of different ARs, and removing them entirely verges on the impossible, as well as being economically unviable. It is therefore desired to reduce the overall level of ARs to an acceptable degree, that is, to a level that is not hazardous to human consumers. This level varies considerably, depending on the AR involved. In some cases, essentially complete removal is necessary, in other cases, higher limits are tolerable.

The traditional method of removal has been distillation. While this has been effective, it is also lengthy and fairly energy-inefficient, especially as multiple passes through a distillation process are required. Other methods have included absorption, ion exchange and solvent extraction. However, a problem often encountered is that these often also remove or destroy essential components of the oil, thus rendering it less useful, and sometimes not at all useful. This is especially true of citrus oils, such as orange oil.

It has now been found that the proportion of ARs in an essential oil may be reduced by an acceptable degree by a particular method. There is therefore provided a method of reducing the proportion of ARs present in an essential oil, comprising the treatment of the oil with an ionic liquid that has at most limited solubility in the oil, the ionic liquid having an anion and a cation chosen from the following table:

| cation | anion |
|---|---|
| dialkylimidazolium | alkylsulfate |
| trialkylimidazolium | dicyanamide |
| dialkylpyridinium | alkylsulfonate |
| dialkylpyrrolidinium | alkylphosphate |
| | thiocyanate |
| | fluoroacetate |
| | fluoroalkyl sulfonate |
| | tetrafluoroborate |
| | halide |

Ionic liquids (ILs) are liquids that exist in completely ionised form without the need for any solvent. They are distinguished by having virtually no vapour pressure. Many varieties are now obtainable commercially and they have been used, for example, in various synthetic chemistry applications, and in some separation processes in the petrochemical industry.

By "at most limited solubility" is meant that the IL is never completely miscible with the oil. In a particular embodiment, it is only slightly miscible, or even completely immiscible, with the oil. Depending on the nature of the oil and the IL, there is a considerable variation in solubilities, but the skilled person can find a combination with only routine experimentation. As a general indication, "at most limited solubility" may be considered as a maximum of 1% of the IL remaining in the oil after an oil and IL mixture is subjected to a water rinse, but there are cases where more will remain and there will still be satisfactory results.

Particular non-limiting examples of essential oils useful in this process are citrus oils, such as orange, lemon, grapefruit and lime oil.

These ILs have been found to remove more than 50% of ARs present with a single extraction:

1-Butyl-2,3-dimethylimidazolium (trialkylimidazolium) tetrafluoroborate
1-Butyl-3-methylimidazolium (dialkylimidazolium) dicyanamide
1-Hexyl-3-methylimidazolium (dialkylimidazolium) chloride
3-Methyl-1-octylimidazolium (dialkylimidazolium) chloride
1-Butyl-3-methylimidazolium methylsulfate
N-Butyl-3-methylpyridinium dicyanamide
1-Butyl-1-methylpyrrolidinium dicyanamide
4-Methyl-N-butylpyridinium tetrafluoroborate.

The following ILs were found to remove than 20% total ARs with a single extraction:

1-Ethyl-3-methylimidazolium (dialkylimidazolium) dicyanamide
1-Ethyl-3-methylimidazolium(dialkylimidazolium) p-toluenesulfonate
1-Ethyl-3-methylimidazolium (dialkylimidazolium) diethylphosphate
1-Ethyl-3-methylimidazolium (dialkylimidazolium) thiocyanate
1-Ethyl-3-methylimidazolium (dialkylimidazolium) ethylsulfate
1-Ethyl-3-methylimidazolium (dialkylimidazolium) trifluoroacetate
1-Ethyl-3-methylimidazolium (dialkylimidazolium) trifluoromethane sulfonate
1-Ethyl-3-methylimidazolium (dialkylimidazolium) tetrafluoroborate
1-Butyl-2,3-dimethylimidazolium (trialkylimidazolium) trifluoromethylsulfonate
1-Propyl-3-methylimidazolium (dialkylimidazolium) iodide.

The ILs hereinabove mentioned are especially effective in the treatment of citrus oils, particularly orange oil. A particularly effective IL for citrus oils, especially orange oil, is 1-ethyl-3-methylimidazolium (dialkylimidazolium) ethylsulfate, which removes nearly all of the ARs, but does not remove any of the essential components of the orange oil.

The method comprises the mixing of the essential oil and IL, for example in a 1:1 weight ratio. The mixture is allowed to stand, for example for about 30 minutes, to separate the oil and IL layers, and the oil layer may be decanted off the IL layer. The oil phase is rinsed with water (for example 1:1 by weight) and the oil layer may be decanted off. This water rinse may be repeated twice, and the oil may be dried, such as by using either sodium sulphate or 3A molecular sieve, for example.

The resulting oil has a considerably reduced concentration of ARs. This will vary with the oil and the nature of the ARs.

The disclosure is further described with reference to the following worked examples, which depict particular embodiments and which are not meant to be in any way limiting.

EXAMPLE 1

20 g of 1-hexyl-3-methylimidazolium chloride was mixed for 30 minutes with an orange oil shown by analysis to contain the following ARs: 2,4-D 2-ethylhexyl ester, 2-phenylphenol, bromopropylate, Carbaryl™, Chlorpyrifos™, Diazinon™, Dicofol™, Ethion™, Imazalil™, Malathion™, Metalaxyl™, Methidathion™, methyl Parathion™, methyl Pyrimiphos™, Prochloraz™, Propargite™, Pyridaphenthion™, and Tetradiphon™.

The IL/oil mixture was poured into a separatory funnel and the IL layer was drained from the funnel. 20 g of deionized water was added to the oil in the separatory funnel and mixed. The two phases were allowed to separate and the water layer was drained from the funnel. The water rinse was repeated two more times, and the oil dried with 5 wt % added sodium sulfate. The resulting oil layer showed a 58% reduction in total AR concentration with a reduction of 95% of 2-phenylphenol and 93% of bromopropylate.

Although the embodiments have been described in detail through the above description and the preceding example, these example is for the purpose of illustration only and it is understood that variations and modifications can be made by one skilled in the art without departing from the spirit and the scope of the disclosure. It should be understood that the embodiments described above are not only in the alternative, but can be combined.

The invention claimed is:

1. A method of reducing the proportion of agricultural residues present in an essential oil, comprising treatment of the oil with an ionic liquid that has at most limited solubility in the oil, the ionic liquid having an anion and a cation chosen from the following table:

| cation | anion |
|---|---|
| dialkylimidazolium | alkylsulfate |
| trialkylimidazolium | dicyanamide |
| dialkylpyridinium | alkylsulfonate |
| dialkylpyrrolidinium | alkylphosphate |
| | thiocyanate |
| | fluoroacetate |
| | fluoroalkyl sulfonate |
| | tetrafluoroborate |
| | halide. |

2. The method according to claim 1, in which the ionic liquid is at least one of the following:

1-Butyl-2,3-dimethylimidazolium (trialkylimidazolium) tetrafluoroborate,

1-Butyl-3-methylimidazolium (dialkylimidazolium) dicyanamide,

1-Hexyl-3-methylimidazolium (dialkylimidazolium) chloride,

3-Methyl-1-octylimidazolium (dialkylimidazolium) chloride,

1-Butyl-3-methylimidazolium methylsulfate,

N-Butyl-3-methylpyridinium dicyanamide,

1-Butyl-1-methylpyrrolidinium dicyanamide,

4-Methyl-N-butylpyridinium tetrafluoroborate,

1-Ethyl-3-methylimidazolium (dialkylimidazolium) dicyanamide,

1-Ethyl-3-methylimidazolium(dialkylimidazolium) p-toluenesulfonate,

1-Ethyl-3-methylimidazolium (dialkylimidazolium) diethylphosphate,

1-Ethyl-3-methylimidazolium (dialkylimidazolium) thiocyanate,

1-Ethyl-3-methylimidazolium (dialkylimidazolium) ethylsulfate,

1-Ethyl-3-methylimidazolium (dialkylimidazolium) trifluoroacetate,

1-Ethyl-3-methylimidazolium (dialkylimidazolium) trifluoromethane sulfonate,

1-Ethyl-3-methylimidazolium (dialkylimidazolium) tetrafluoroborate,

1-Butyl-2,3-dimethylimidazolium (trialkylimidazolium) trifluoromethylsulfonate, or 1-Propyl-3-methylimidazolium (dialkylimidazolium) iodide.

3. The method according to claim 1, in which the essential oil is a citrus oil and the ionic liquid is 1-ethyl-3-methylimidazolium (dialkylimidazolium) ethylsulfate.

4. The method according to claim 3, in which the citrus oil is orange oil.

5. The method according to claim 1, in which the treatment of the oil with the ionic liquid comprises mixing of the oil and the ionic liquid, allowing a layer of the oil to separate from a layer of the ionic liquid, and removing at least one of the oil layer or the ionic liquid layer.

6. The method according to claim 5, in which the treated oil is rinsed with water, and the rinsed oil layer is separated from the water.

7. The method according to claim 6, in which the rinsed oil is dried.

* * * * *